US007175474B1

(12) United States Patent
Chang et al.

(10) Patent No.: US 7,175,474 B1
(45) Date of Patent: Feb. 13, 2007

(54) POWER ADAPTER HAVING REPLACEABLE PLUGS

(75) Inventors: Chi-Lin Chang, Taipei (TW); Yuan-Hen Fu, Taipei (TW); Min-Jeng Lee, Taipei (TW)

(73) Assignee: Elementech International Co., Ltd., Taipei (TW)

( * ) Notice: Subject to any disclaimer, the term of this patent is extended or adjusted under 35 U.S.C. 154(b) by 0 days.

(21) Appl. No.: 11/413,086

(22) Filed: Apr. 28, 2006

(51) Int. Cl.
*H01R 13/72* (2006.01)

(52) U.S. Cl. ..... 439/501; 439/638

(58) Field of Classification Search ..... 439/638, 439/501, 4, 668; 362/258; 191/12.2 R
See application file for complete search history.

(56) References Cited

U.S. PATENT DOCUMENTS 1,153,829 A * 9/1915 Rueckert ..... 242/377
5,593,323 A * 1/1997 Dernehl ..... 439/668
5,599,204 A * 2/1997 Glassford ..... 439/502
6,994,592 B1 * 2/2006 Gannon ..... 439/638
7,011,538 B2 * 3/2006 Chang ..... 439/172

FOREIGN PATENT DOCUMENTS

TW 93206466 1/2005

* cited by examiner

*Primary Examiner*—Tho D. Ta

(57) ABSTRACT

A power adapter having replaceable plugs includes a main body, a socket module, a conducting wire, a rotating casing and a household plug. The main body includes a wire containing groove, an automobile plug and a connecting base formed on both sides of the wire containing groove, and electric conducting terminals disposed at the connecting base. The socket module includes a fixing base connected to the connecting base and a socket contained inside the fixing base, and the socket is electrically connected to each electric conducting terminal. The conducting wire is electrically connected to an automobile plug and each electric conducting terminal, wound into a wire containing groove, and covered by a rotating casing. The rotating casing is rotated for winding the conducting wire, and a replaceable household plug is inserted into the socket, and the household plug is electrically connected to a circuit of the main body.

13 Claims, 8 Drawing Sheets

POWER ADAPTER HAVING REPLACEABLE PLUGS

BACKGROUND OF THE INVENTION

1. Field of the Invention

The present invention relates to a power adapter having replaceable plugs, and more particularly to a power adaptor having replaceable plugs connectible to different sockets.

2. Description of Prior Art

As socioeconomic transactions become increasingly active, communications between people become more important than ever. In addition, mobile commercial affairs become popular, and thus the possession rate and using rate of mobile phones, personal digital assistants (PDAs), digital cameras and notebook computes are increased greatly. In addition to the communication signals, the battery for supplying electric power is very important to these mobile commercial affairs. Although communication companies and battery manufacturers constantly develop long-hour batteries, such long-hour batteries have a limited time of use of the battery and require a battery recharge from a power adapter.

A traditional power adapter as disclosed in Taiwan Utility Model Application No. 93206466 comprises a main body; an automobile plug installed at the main body and connected to a recharge circuit and normally covered by a rotating casing; a household plug installed at the main body and connected to a recharge circuit, such that a push button disposed at a cover body can push the household plug to slide out from a storage chamber to a fixed position for the use of the plug; a winding device installed at the main body and including a wire containing groove and a connecting member for connecting the wire containing groove; and a conducting wire connectively drawn out from an end of the wire containing groove and the recharge circuit.

Although traditional power adapters have the function of winding the conducting wire without breaking the core wire inside the conducting wire, they still have the following problems. Since the traditional power adapters do not come with a mechanism to fit various different types of household sockets for the electric connection of a household plug, therefore the applicable area is limited and the convenience of the application is reduced. Further, the traditional power adapters do not come with a latching or fixing mechanism for winding or releasing the conducting wire, and thus cannot appropriately control the length of the required conducting wire. If the conducting wire is pulled too long, it will wastes unnecessary time for winding the wire. Furthermore, the traditional power adapter does not have a conducting wire member, so that when the conducting wire is wound, the conducting wire cannot be orderly wound into the wire containing groove, and the conducting wire may even be wound into a rotating casing in a mutually overlapped manner, and thus making the winding job very inconvenient and troublesome.

In view of the foregoing shortcomings of the prior art, the inventor of the present invention based on years of experience in the related industry to conduct experiments and modifications, and finally designed a power adapter having replaceable plugs in accordance with the present invention to overcome the shortcomings of the prior art.

SUMMARY OF THE INVENTION

Therefore, the present invention is to overcome the shortcomings of the prior art by providing a power adapter having replaceable plugs that installs a household plug into a replaceable socket of a socket module to fit the connection of various different models of household sockets and improve the popularity and convenience of the use.

A power adapter having replaceable plugs of the present invention comprises a main body, a socket module, a conducting wire, a rotating casing and a household plug, wherein the main body includes a wire containing groove, an automobile plug and a connecting base formed on both sides of the wire containing groove respectively, and a set of electric conducting terminals disposed on a distal surface of the connecting base. The socket module includes a fixing base connected to the connecting base and a socket contained inside the fixing base, and the socket is electrically connected to each electric conducting terminal inside the connecting base. Further, an end of the conducting wire is electrically and separately connected to an automobile plug and each electric conducting terminal, and the conducting wire is wound into a wire containing groove, and a rotating casing covers the exterior of the conducting wire, and the rotating casing can rotate with respect to the main body for winding the conducting wire, and the replaceable household plug can be inserted into the socket, and the household plug is electrically connected to a circuit of the main body.

The present invention is to provide a power adapter having replaceable plugs that installs a latching or fixing mechanism for winding or releasing a conducting wire, so as to appropriately control the length of the conducting wire and greatly save the time of winding the conducting wire.

In a preferred embodiment of the present invention, the main body includes a positioning member disposed between a wire containing groove and an automobile plug, and the rotating casing includes an upper cover, and the upper cover has a pressing member corresponding to the positioning member for pressing a pressing member to push the positioning member into the main body, so as to control the length of the conducting wire after pulling or winding the conducting wire.

The present invention is to provide a power adapter having replaceable plugs that installs a conducting wire member for orderly and neatly winding the conducting wire into a rotating casing.

In a preferred embodiment of the present invention, the rotating casing has a conducting wire member that can slide with respect to the rotating casing, and the conducting wire member includes a plate body parallel to a guiding track of the casing, an electric starting member perpendicular to the plate body and capable of sliding along the wire containing groove of the main body, two channels separately formed at the plate body and the electric starting member, and the channel is provided for embedding the guiding track of the casing, and a wire containing slot formed at the middle of the plate body for receiving the conducting wire.

BRIEF DESCRIPTION OF DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

The technical characteristics, features and advantages of the present invention will become apparent in the following detailed description of the preferred embodiments with reference to the accompanying drawings, and the drawings are provided for reference and illustration and not intended for limiting the scope of the present invention.

Figure 1:
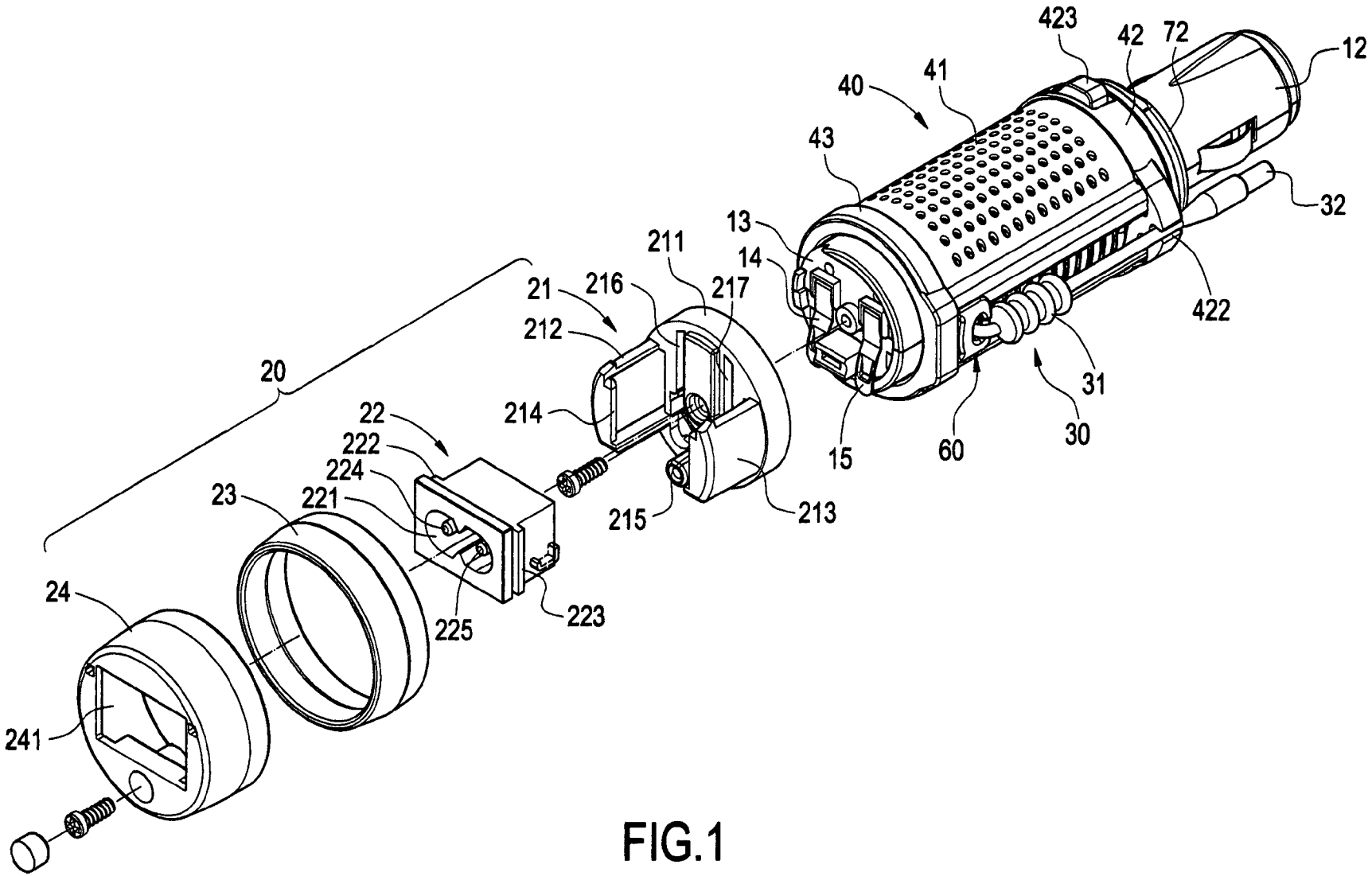
FIG. 1 is an exploded view of a portion of the present invention.
Figure 2:
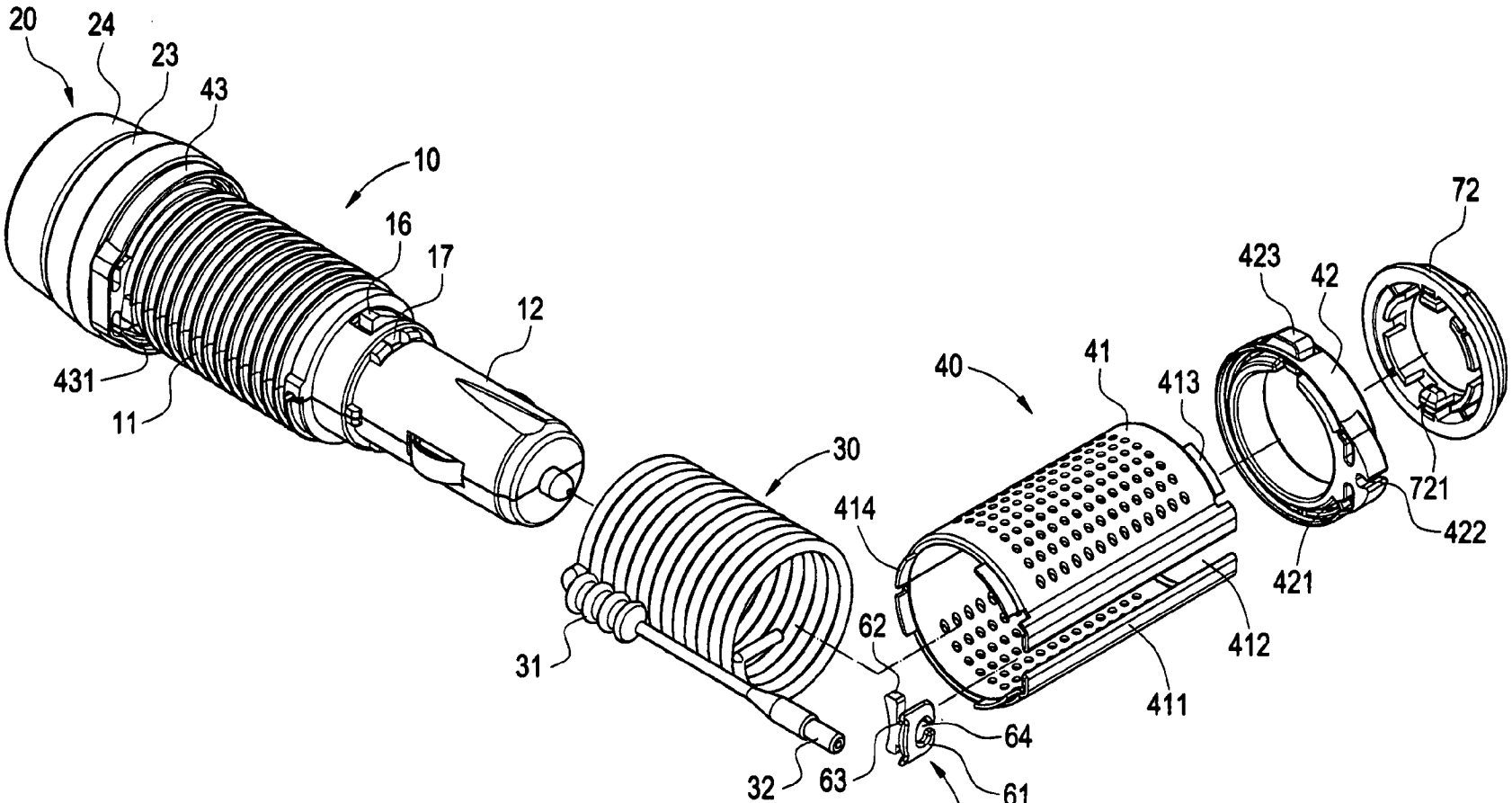
FIG. 2 is an exploded view of another portion of the present invention.
Figure 3:
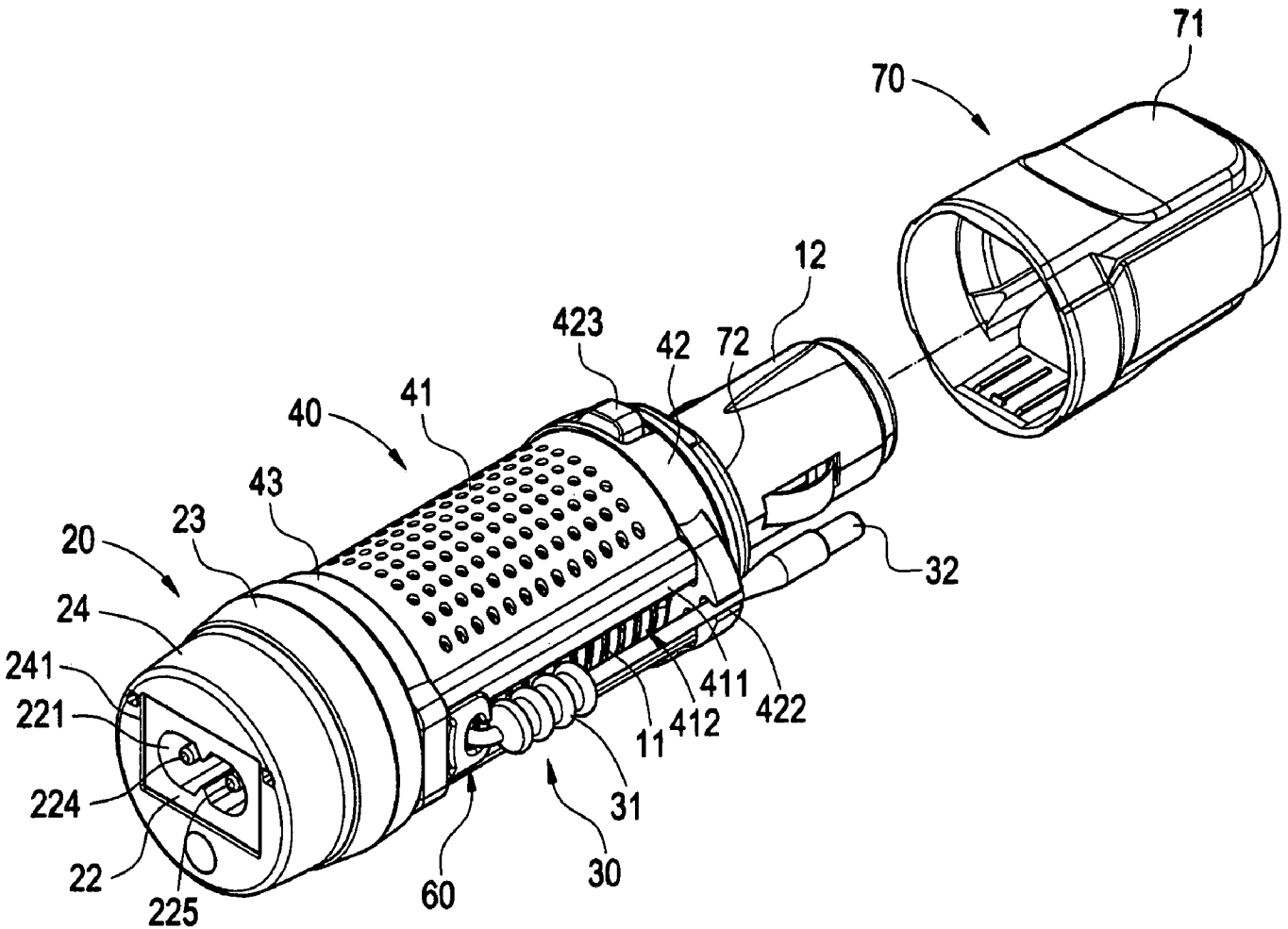
FIG. 3 is an exploded view of the assembly as depicted in FIG. 3 and an external cover module of the present invention.

Referring to FIGS. 1 to 4 for the exploded view of a portion of the present invention, the exploded view of another portion of the present invention, the exploded view of the assembly as depicted in FIG. 3 and an external cover module of the present invention, and the exploded view of a plug which is not plugged into a socket yet according to the present invention respectively, a power adapter having replaceable plugs comprises a main body 10, a socket module 20, a conducting wire 30, a rotating casing 40 and a plug 50.

The main body 10 is substantially in a cylindrical shape and includes components such as a transformer (not shown in the figure) therein, a spiral wire containing groove 11 disposed at the external periphery of the main body, an automobile plug 12 protruded outwardly from a side of the wire containing groove 11, a connecting base 13 formed on another side of the wire containing groove 11, a set of electric conducting terminals 14, 15 disposed at a distal surface of the connecting base 13, and a positioning member 16 and a set of symmetric latch holes 17 disposed on the main body 10 between the wire containing groove 11 and the automobile plug 12 (as shown in FIG. 2).

The socket module 20 includes a fixing base 21, a socket 22, a connecting ring 23 and a bottom cover 24, and the fixing base 21 is connected to the connecting base 13 of the main body 10 by a fixing element such as a screw. The fixing base 21 includes a circular disk body 211 and two snap-in arms 212, 213 extended upwardly and separately from both corresponding lateral sides of the disk body 211, a pressing bar 214, 215 protruded inwardly from the internal side of the top of each snap-in arm 212, 213, and two parallel penetrating grooves 216, 217 disposed on the disk body 211 at the middle of the two snap-in arms 212, 213, and each penetrating groove 216, 217 is installed corresponding to each electric conducting terminal 14, 15 of the connecting base 13.

The socket 22 is a rectangular body having a terminal containing groove 221 disposed at a distal surface of the socket 22, ribs 222, 223 separately protruded from the top of both front and rear sides of the socket 22, and each rib 222, 223 is installed corresponding to each pressing bar 214, 215 of the fixing base 21; and the terminal containing groove 221 of the socket 22 includes two electric connecting terminals 224, 225 therein, and another end of each electric connecting terminal 224, 225 is extended out of the socket 22 and passed into each penetrating groove 216, 217 of the fixing base 21 correspondingly and electrically coupled to each electric conducting terminal 14, 15 of the connecting base 13; and the connecting ring 23 is a stairway-like circular ring with its upper half connected to the external periphery of the disk body 211 of the fixing base 21; and the bottom surface of the bottom cover 24 includes a rectangular hole 241 for receiving the bottom surface of the socket 22, and the top of the bottom cover 24 is disposed in the second half of the connecting ring 23.

An end of the conducting wire 30 is electrically and separately coupled to the an automobile plug 12 of the main body 10 and each electric conducting terminal 14, 15, wherein each electric conducting terminal 14, 15 is coupled to the conducting wire 30 through a transformer inside the main body 10, and the conducting wire 30 is wound orderly from top to bottom into the wire containing groove 11 of the main body 10 (as shown in FIG. 2), and another end of the conducting wire 30 forms a plurality of stopping rings 31 stacked with each other, and a plug 32 is connected to a distal end of the external side of the stopping ring 31, and the plug 32 comes with different specifications to fit the connection of its corresponding socket of an electronic device.

The rotating casing 40 is provided for covering the exterior of the main body 10 wound with the conducting wire 30 and being rotated with respect to the main body 10 for winding the conducting wire 30. The rotating casing 40 includes a circular casing 41, an upper cover 42 and a lower cover 43 (as shown in FIG. 2), and the casing 41 forms two guiding tracks 411 parallel to a side of the axis, an opening groove disposed at the middle of the guiding track 411, a plurality of through holes disposed around the periphery of the casing 41, and a plurality of fixing plates 413, 414 protruded outwardly and separately from front and rear distal surfaces of the casing 41. The upper cover 42 is substantially in a circular shape and connected to the exterior of the positioning member 16 of the main body 10 correspondingly, and the bottom surface includes a plurality of insert slots 421 for inserting the fixing plate 414 of the casing 41, and the external periphery of the upper cover 42 includes a wire clamping groove 422 for embedding and connecting an end of the conducting wire 30 and protruding and exposing the conducing wire 30 from the exterior of the casing 41. The lower cover 43 is connected to the exterior of the connecting base 13 of the main body 10 (as shown in FIG. 1), and the top also includes a plurality of insert slots 431 for inserting the corresponding fixing plate 414 of the casing 41 and integrally connecting the casing 41.

In addition, the periphery of the upper cover 42 includes a resilient pressing member 423 (as shown in FIG. 2), and the pressing member 423 is installed corresponding to the positioning member 16 of the main body 10, so that the pressing member 423 can be pressed to push the positioning member 16 into the main body 10, and thus providing a latching and positioning effect to facilitate winding and releasing the conducting wire 30 and defining the latch mechanism of the present invention.

Figure 4:
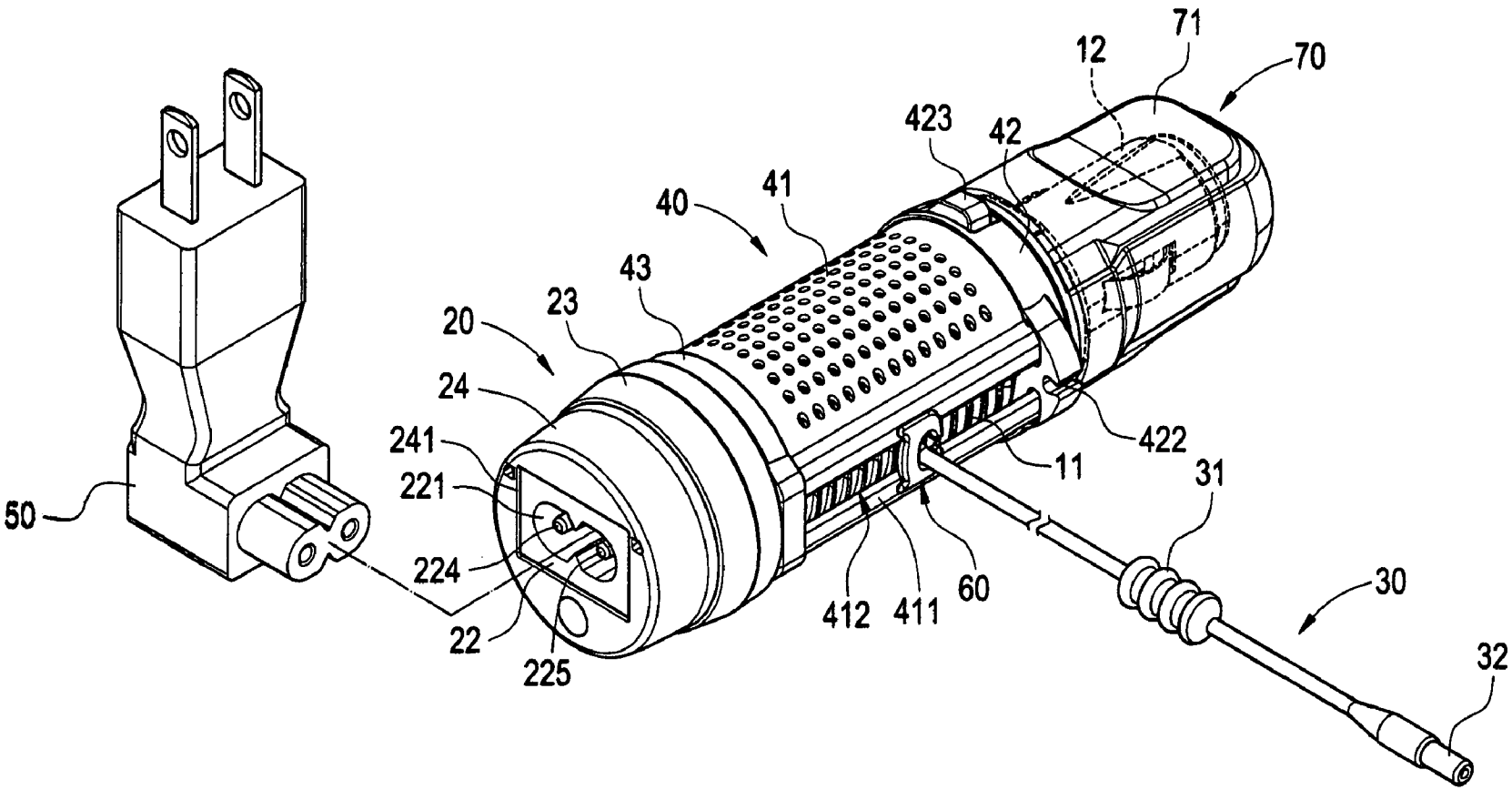
FIG. 4 is an exploded view of a plug which is not plugged into a socket yet according to the present invention.
Figure 5:
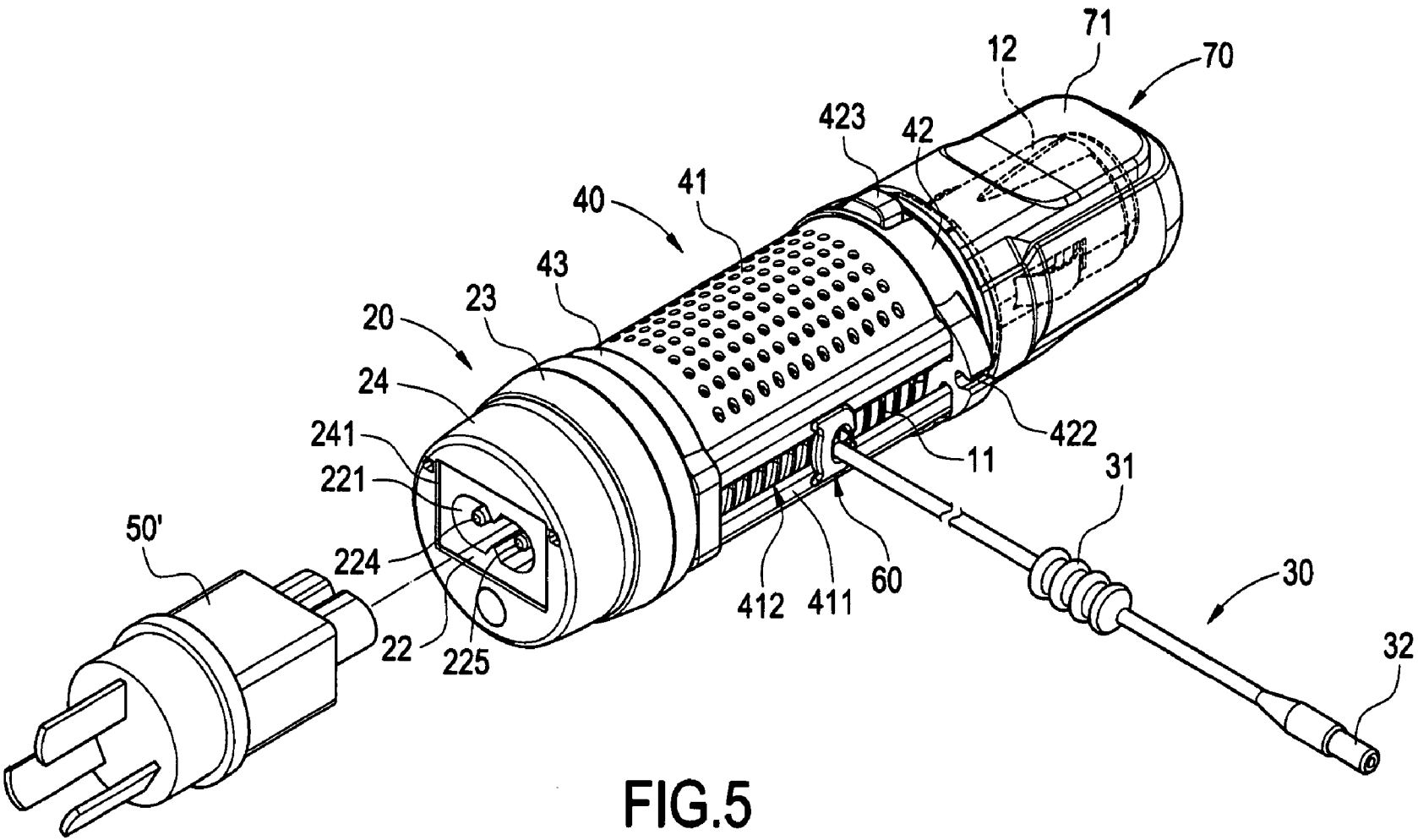
FIG. 5 is an exploded view of another plug which is not plugged into a socket yet according to the present invention.

The household plug 50 (as shown in FIG. 4) can be inserted replaceably into a socket 22 of the socket module 20. Each electric connecting terminal 224, 225 of the socket 22 is connected to the circuit of the main body 10. Besides the two-plate insert pins in accordance with this embodiment, the household plug 50 could be a household plug 50' with three-plate insert pins as shown in FIG. 5 or a plug with other different forms or specifications.

The present invention further comprises a conducting wire member 60 (as shown in FIG. 2) movably connected to a guiding track 411 of the casing 41, a guiding track 411 disposed at the conducting wire member 60 and parallel to a plate body 61 of the casing 41, an electric starting member 62 perpendicular to the plate body 61 and capable of sliding along the wire containing groove 11 of the main body 10, two channels 63 separately formed at the plate body 61 and the electric starting member 62, and each channel 63 is provided for embedding the guiding track 411 of the casing 41, and a wire containing slot 64 formed at the middle of the plate body 61. The wire containing slot 64 is provided for installing a stopping ring 31 of the conducting wire 30 from an internal side, such that the conducting wire 30 can be orderly and neatly wound between the casing 41 and the wire containing groove 11.

The present invention further comprises an external cover module 70 (as shown in FIG. 3) for covering and connecting the exterior of the automobile plug 12 of the main body 10, and the external cover module 70 includes a cover body 71 and a latch member 72 (as shown in FIG. 2), and two symmetric hooks 721 are protruded from the internal side of the latch member 72, and each hook 721 is latched directly into each latch hole 17 of the main body 10, and then the cover body 71 is covered onto the exterior of the automobile plug 12 and connected to the latch member 72.

Figure 6:
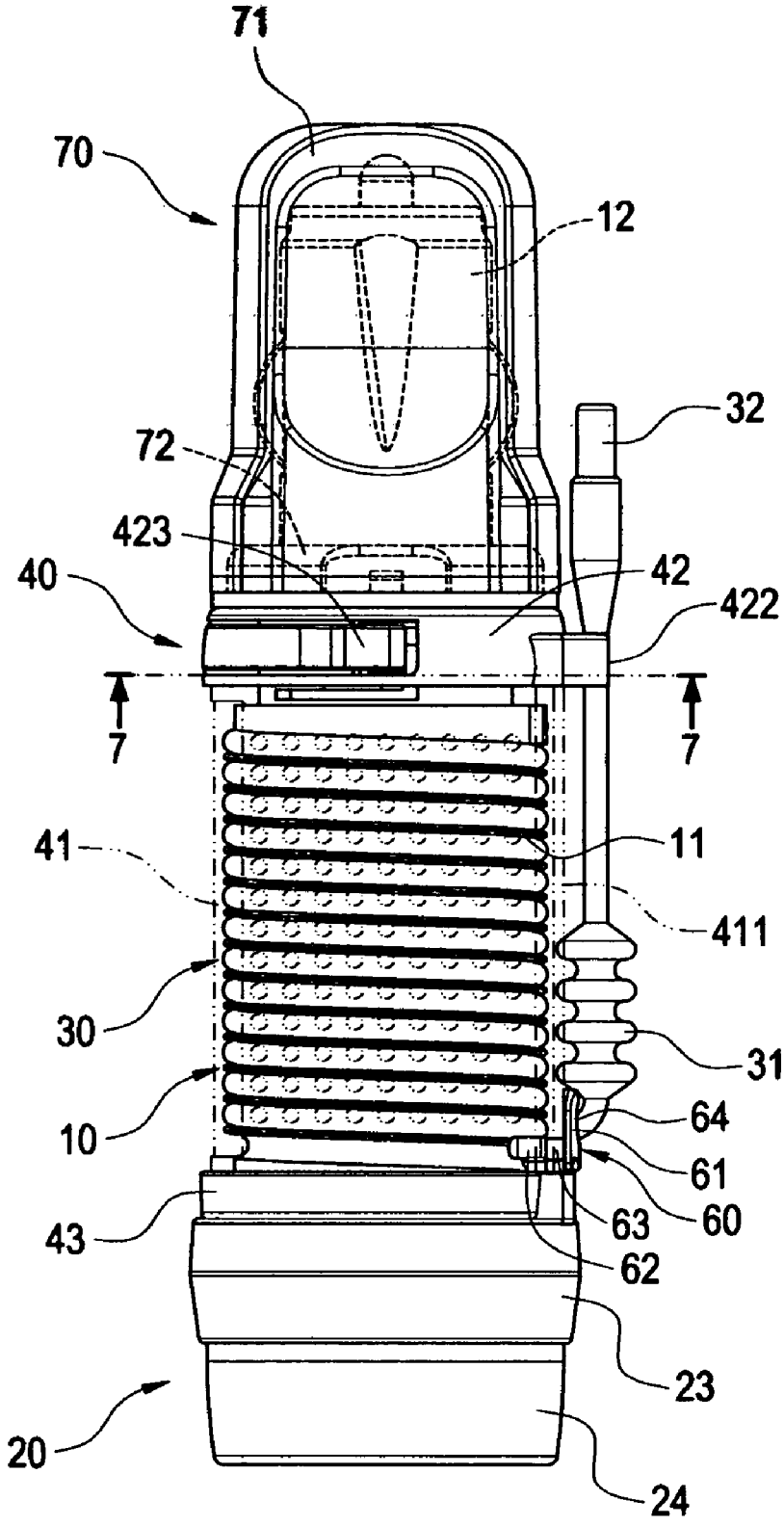
FIG. 6 is a front view of an assembled external cover module of the present invention.
Figure 7:
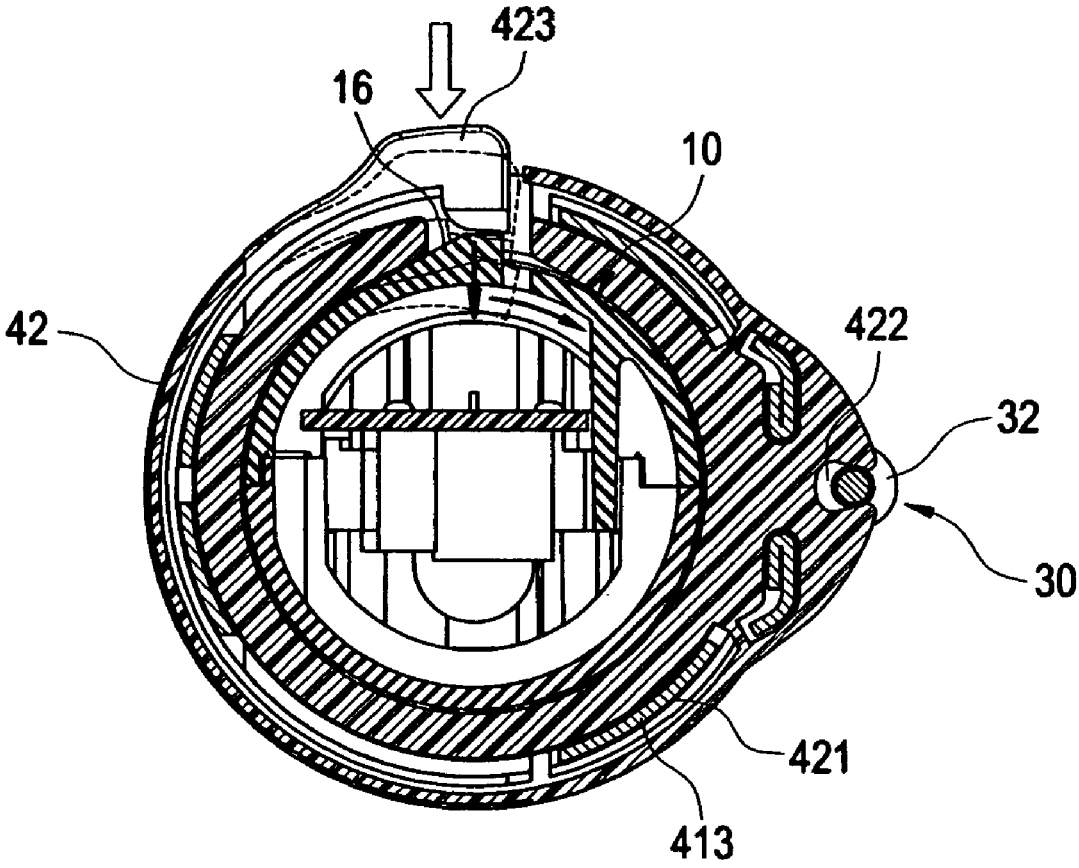
FIG. 7 is a cross-sectional view of Section 7—7 as depicted in FIG. 6.
Figure 8:
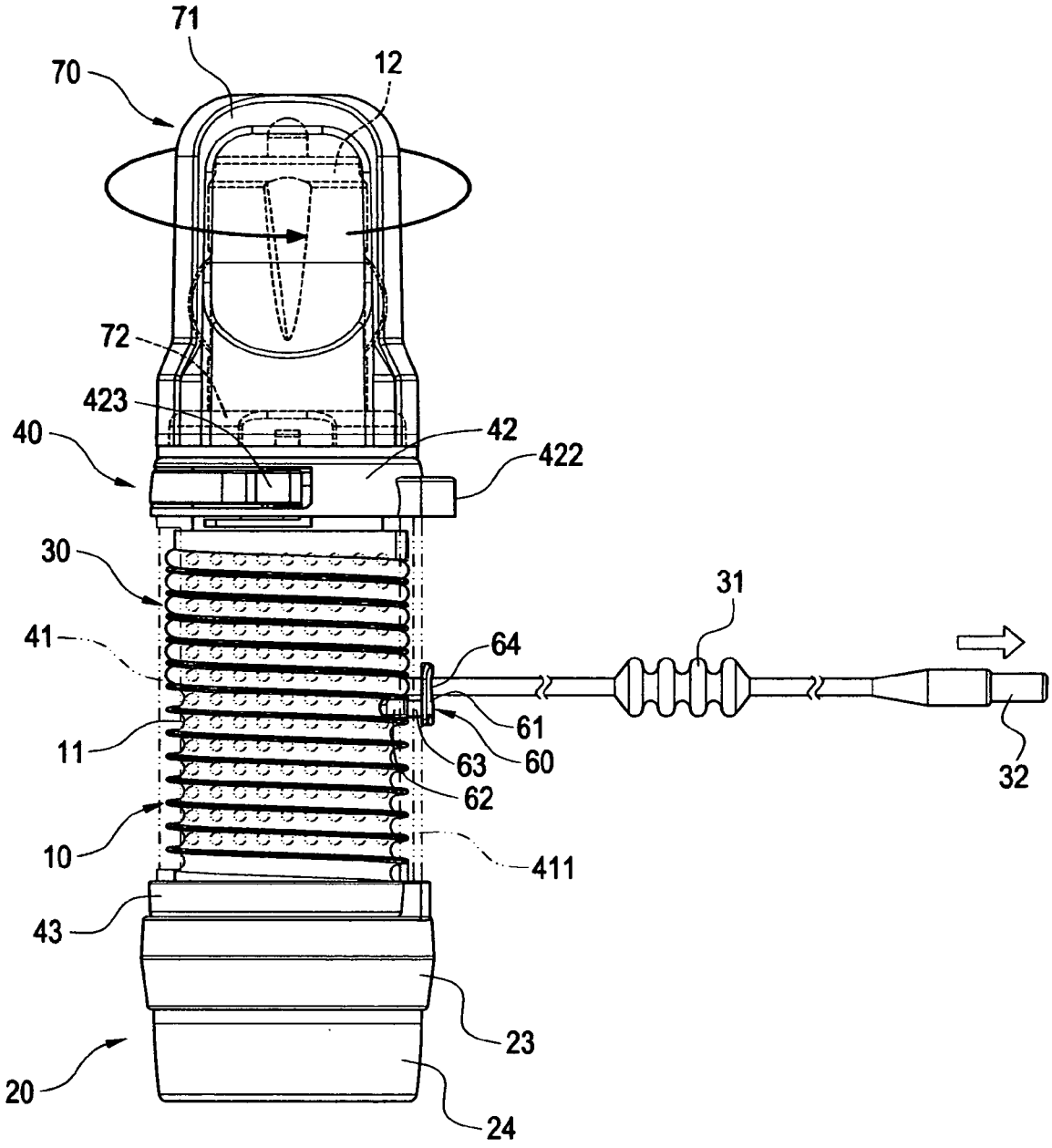
FIG. 8 is a schematic view of an application of the present invention.

Referring to FIGS. 6 to 8 for the front view of the external cover module assembled with the present invention, the cross-sectional view of Section 7—7 as depicted in FIG. 6, and the schematic view of an application of the present invention respectively, a household socket can be changed to fit various different types of its corresponding household plug 50, and an end of the household plug 50 is inserted into the socket 22 of the socket module 20, and a user can hold the exterior of the rotating casing 40 with a hand and press the pressing member 423 with a thumb, such that the pressing member 423 presses the positioning member 16 of the main body 10, and the positioning member 16 is withdrawn into the upper cover 42 (as shown in FIG. 7). By then, the positioning member 16 is released from the latching effect of the upper cover 42, and the user can pull the conducting wire 30 out by another hand, and the main body 10 can rotate with respect to the rotating casing. In the meantime, the conducting wire member 60 slides along the sliding track 411 of the casing 41, so that when the conducting wire 30 is pulled to a predetermined length, the thumb pressing at pressing member 423 for pressing the conducting wire 30 can be released, and the positioning member 16 will be bounced back to latch and fix to the interior of the upper cover 42.

When the conducting wire 30 is wound, the user can hold the exterior of the rotating casing 40 by a hand and presses the pressing member 42 by a thumb, such that the pressing member 423 presses the positioning member 16 of the main body 10, and the positioning member 16 is withdrawn into the upper cover 42. The user can rotate the external cover module 70 by another hand, so that the main body 10 can rotate with respect to the rotating casing 40. In the meantime, the conducting wire member 60 slides along the sliding track 411 of the casing 41, and the conducting wire 30 can be neatly wound into the wire containing groove 11 of the main body 10.

In summation of the description above, the power adapter having replaceable plugs of the invention definitely achieves the foregoing objectives and complies with the patent application requirements.

The present invention are illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A power adapter having replaceable plugs, comprising: a main body, including a wire containing groove spirally disposed around an external periphery of the main body, an automobile plug protruded from a side of the wire containing groove, a connecting base disposed on another side of the wire containing groove, and a set of electric conducting terminals disposed at a distal surface of the connecting base;

a socket module, including a fixing base connected to the connecting base of the main body and a socket contained in the fixing base, and the socket electrically coupled to each electric conducting terminal of the connecting base;

a conducting wire, having an end electrically and separately coupled to the automobile plug of the main body and each electric conducting terminal, and orderly wound into the wire containing groove in the main body;

a rotating casing, for covering the main body wound with the conducting wire, such that another end of the conducting wire is protruded and exposed from an exterior of the rotating casing, and the rotating casing can be rotated with respect to the main body for winding the conducting wire;

and a household plug, replaceably inserted into the socket of the socket module and electrically coupled to the main body.

2. The power adapter having replaceable plugs of claim 1, wherein the conducting wire includes a plurality of stopping rings exposed from the exterior of the rotating casing, and a plug connected to a distal end of an external side of the stopping ring.

3. The power adapter having replaceable plugs of claim 1, further comprising a latch mechanism, and the latch mechanism includes a positioning member and a pressing member, and the positioning member is installed between the wire containing groove of the main body and the automobile plug, and the rotating casing includes an upper cover, and a pressing member disposed at the upper cover and corresponding to the positioning member for pressing the pressing member to push the positioning member into the main body.

4. The power adapter having replaceable plugs of claim 1, wherein the fixing base includes a disk body, two snap-in arms extended upward from two corresponding lateral sides of the disk body, a pressing bar protruded inwardly to an internal side of a top edge of each snap-in arm, and two parallel penetrating grooves disposed at the disk body between the two snap-in arms, and each penetrating groove corresponds to each electric conducting terminal of the connecting base.

5. The power adapter having replaceable plugs of claim 4, wherein the socket includes a terminal containing groove, two electric connecting terminals disposed inside the terminal containing groove, and another end of each electric connecting terminal is protruded from the socket and passed into each penetrating groove of the fixing base correspondingly and electrically coupled to each electric conducting terminal of the connecting base.

6. The power adapter having replaceable plugs of claim 4, wherein the socket module further includes a connecting ring and a bottom cover, and the upper half of the connecting ring is sheathed into the external periphery of the disk body of the fixing base, and the bottom surface of the bottom cover includes a rectangular hole for receiving the bottom of the socket, and the top of the bottom cover is provided for receiving the lower half of the connecting ring.

7. The power adapter having replaceable plugs of claim 1, wherein the rotating casing includes a circular casing, an upper cover and a lower cover respectively coupled to both ends of the casing, two guiding tracks formed on a side of the casing and parallel to an axis of the casing, and an opening groove disposed at the middle of each guiding track.

8. The power adapter having replaceable plugs of claim 7, wherein the casing includes a plurality of fixing plates protruded outwardly from front and rear distal surfaces of the casing, and an insert slot disposed separately on the internal side of the upper cover and the lower cover, and each insert slot connects each fixing plate of the casing.

9. The power adapter having replaceable plugs of claim 7, wherein the upper cover includes a wire clamping groove disposed around the external periphery of the upper cover, for embedding and fixing the conducting wire.

10. The power adapter having replaceable plugs of claim 7, further comprising a conducting wire member movably coupled to the guiding track of the casing.

11. The power adapter having replaceable plugs of claim 10, wherein the conducting wire member includes a plate body parallel to the guiding track of the casing, an electric starting member perpendicular to the plate body and capable of sliding along the wire containing groove of the main body, two channels formed separately on the plate body and the electric starting member for embedding the guiding track of the casing, and a wire containing slot formed at the center of the plate body for receiving the wire containing slot.

12. The power adapter having replaceable plugs of claim 1, further comprising an external cover module for covering and connecting the exterior of the automobile plug of the main body.

13. The power adapter having replaceable plugs of claim 12, wherein the external cover module includes a cover body and a latch member, and the cover body covers the exterior of the automobile plug, and the latch member has two hooks protruded from the internal side of the latch member, and the main body has two latch holes disposed between the wire containing groove and the automobile plug, and each hook is latched into each latch hole of the main body correspondingly.

* * * * *